United States Patent [19]

Ishido et al.

[11] Patent Number: 4,519,424

[45] Date of Patent: May 28, 1985

[54] HEALD ASSEMBLY OF LOOM

[75] Inventors: Takao Ishido, Higashikurume; Masasi Nakao, Koganei; Takao Honya, Higashikurume; Yukio Mizuno, Kodaira, all of Japan

[73] Assignee: Nissan Motor Company, Limited, Yokohama, Japan

[21] Appl. No.: 401,212

[22] Filed: Jul. 23, 1982

[30] Foreign Application Priority Data

| | | | |
|---|---|---|---|
| Aug. 19, 1981 | [JP] | Japan | 56-128696 |
| Aug. 25, 1981 | [JP] | Japan | 56-132080 |
| Aug. 25, 1981 | [JP] | Japan | 56-132079 |
| Aug. 25, 1981 | [JP] | Japan | 56-132081 |
| Aug. 28, 1981 | [JP] | Japan | 56-126470[U] |
| Sep. 2, 1981 | [JP] | Japan | 56-129516[U] |
| Sep. 2, 1981 | [JP] | Japan | 56-129517[U] |

[51] Int. Cl.[3] ..... D03C 9/06

[52] U.S. Cl. ..... 139/91

[58] Field of Search ..... 139/91, 92

[56] References Cited

U.S. PATENT DOCUMENTS

| | | | |
|---|---|---|---|
| 761,677 | 6/1904 | Howard | 139/91 |
| 2,461,497 | 2/1949 | Kaufmann | 139/92 |
| 2,645,251 | 7/1953 | Haenny | 139/92 |
| 3,895,655 | 7/1975 | Sujdak et al. | 139/92 |

FOREIGN PATENT DOCUMENTS

| | | | |
|---|---|---|---|
| 103260 | 6/1899 | Fed. Rep. of Germany | 139/91 |
| 6124 | of 1904 | United Kingdom | 139/91 |

*Primary Examiner*—Henry S. Jaudon

*Attorney, Agent, or Firm*—Lane, Aitken & Kananen

[57] ABSTRACT

A heald assembly of a loom, comprises a heald frame including two beam members which are formed with respective two inner faces which face to each other; two straight elongated openings formed respectively in the two beam members; two straight elongated slits formed respectively on the two inner faces of the heald frame beam members and merging respectively in the two straight elongated openings; a plurality of healds each having a heald body, and two installation sections secured respectively at the opposite end portions of the heald body, each heald installation section being located within the elongated opening and larger in width than the elongated slit; and a device for maintaining a damping-contact between each heald installation section and the heald frame beam member, thereby achieving weight and noise reduction of the heald assembly while maintaining secure connection between each heald and the heald frame.

21 Claims, 48 Drawing Figures

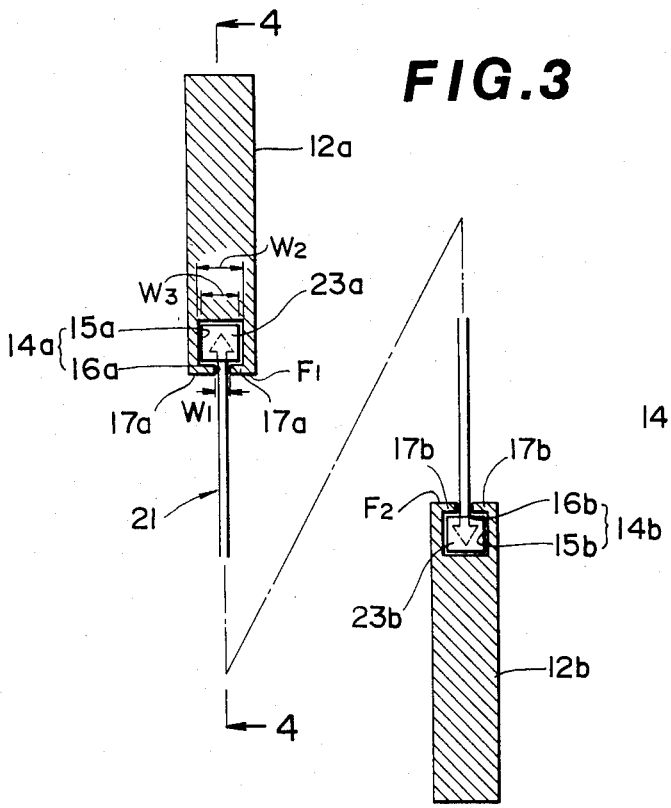
FIG.3
FIG.4
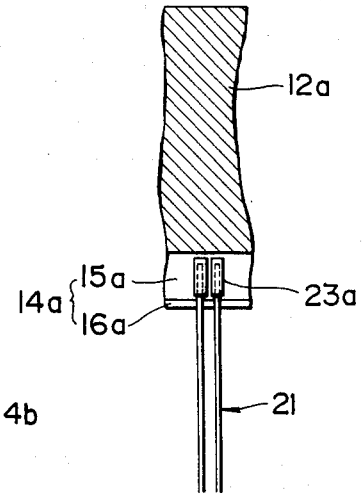
FIG.5
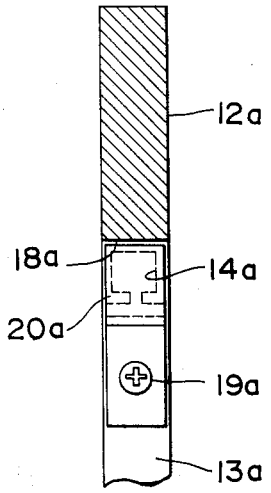
FIG.6
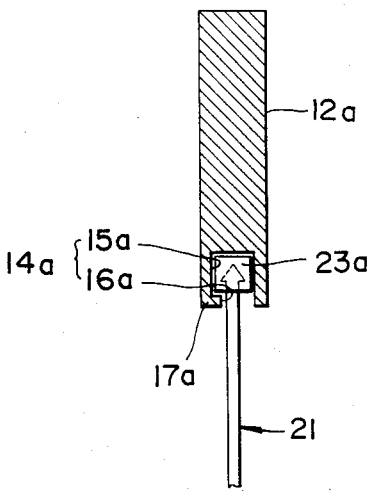

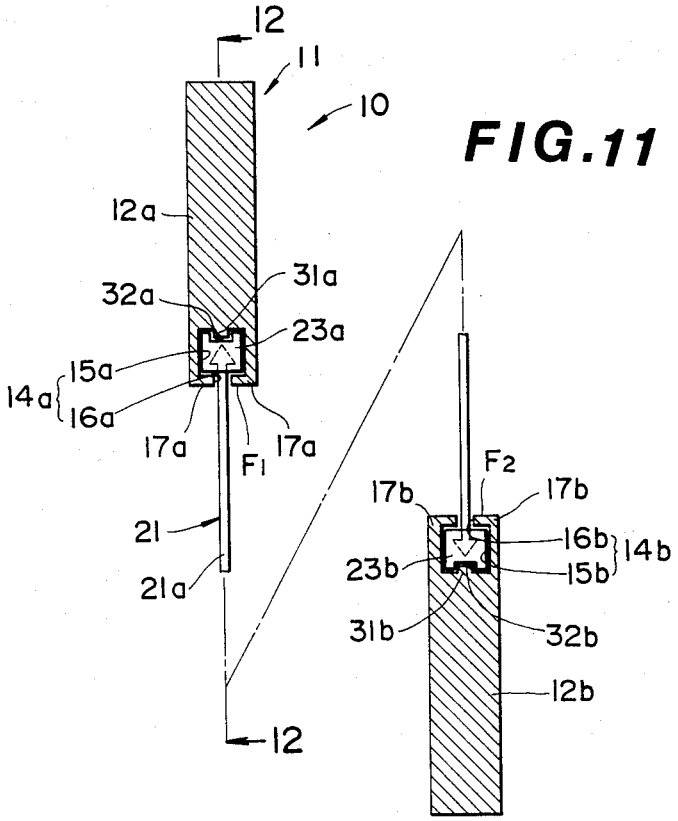
FIG.11
FIG.12
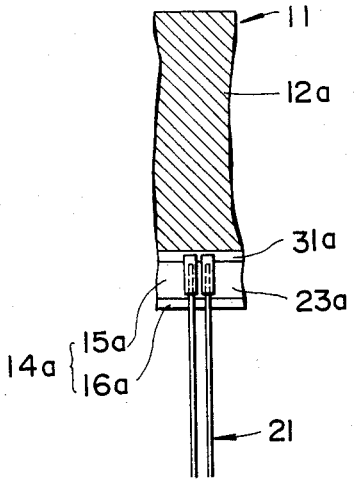

HEALD ASSEMBLY OF LOOM

BACKGROUND OF THE INVENTION

1. Field of the Invention

This invention relates improvements in a loom heald assembly including a heald frame and a plurality of healds used for shedding operation of warp yarns, and more particularly to an installation structure of the healds onto the heald frame.

2. Description of the Prior Art

In connection with conventional loom heald assemblies, a heald frame is usually provided with a pair of metal heald bars which are located in parallel with heald frame beam members. A plurality of healds made of metal are installed between the heald bars in a manner that the opposite ends of each heald are connected to the heald bars, respectively. However, metal-to-metal contact is made between each heald bar and each connected heald end, thus generating considerable noise. Besides, such a heald assembly is heavy in weight due to the elongated metal heald bars, and therefore not suitable for a high operational speed loom.

BRIEF SUMMARY OF THE INVENTION

In accordance with the present invention, a heald assembly of a loom, comprises a heald frame including two beam members which are formed respectively with two inner faces which face toward each other. Each heald frame beam member is formed with a straight elongated opening which extends along the length of the corresponding beam member. Each heald frame beam member is further formed with a straight elongated slit which extends along the straight elongated opening and merges in the straight elongated opening. A plurality of healds are installed onto the heald frame. Each heald includes a heald body which is provided at its opposite end portions with two opposite installation sections each located within the straight elongated opening. Each heald installation section is smaller in width than the straight elongated opening and larger in width than the straight elongated slit. Additionally, a damping-contact is maintained between the heald installation section of each heald and the corresponding heald frame beam member.

With the thus arranged heald assembly, conventional heald bars can be omitted, thereby accomplishing the weight reduction of the heald assembly. Besides, noise reduction is achieved by virtue of the damping-contact between the healds and the heald frame, while maintaining secure connection therebetween. Thus, the heald assembly of the present invention is suitable for high operational speed looms.

BRIEF DESCRIPTION OF THE DRAWINGS

The features and advantages of the heald assembly according to the present invention will be more clearly appreciated from the following description taken in conjunction with the accompanying drawings in which like reference numerals designate the corresponding parts or elements throughout the various embodiments of the present invention, in which:

FIG. 3 is a cross-sectional view taken in the direction of arrows substantially along the line 3—3 of FIG. 2;

FIG. 4 is a cross-sectional view taken in the direction of arrows substantially along the line 4—4 of FIG. 3;

FIG. 5 is a cross-sectional view taken in the direction of arrows substantially along the line 5—5 of FIG. 2;

FIG. 6 is a cross-sectional view similar to FIG. 3, but showing a modification of the embodiment of FIG. 1;

FIG. 11 is a sectional side elevation of a second embodiment of the heald assembly according to the present invention;

FIG. 12 is a cross-sectional view taken in the direction of arrows substantially along the line 12—12 of FIG. 11;

DETAILED DESCRIPTION OF THE INVENTION

Figure 1:
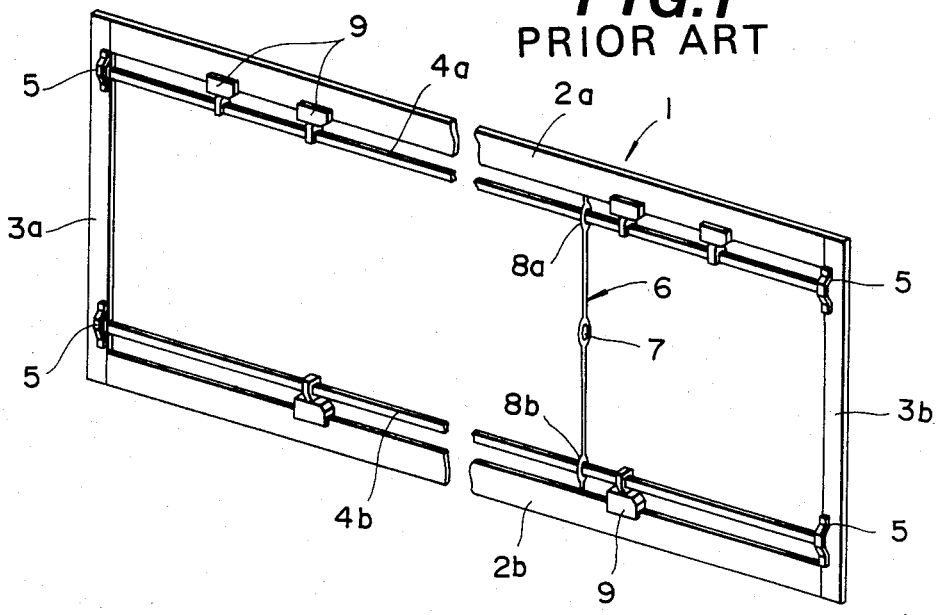
FIG.1 PRIOR ART
FIG. 1 is a perspective view of a conventional heald assembly for use in a loom.
Figure 2:
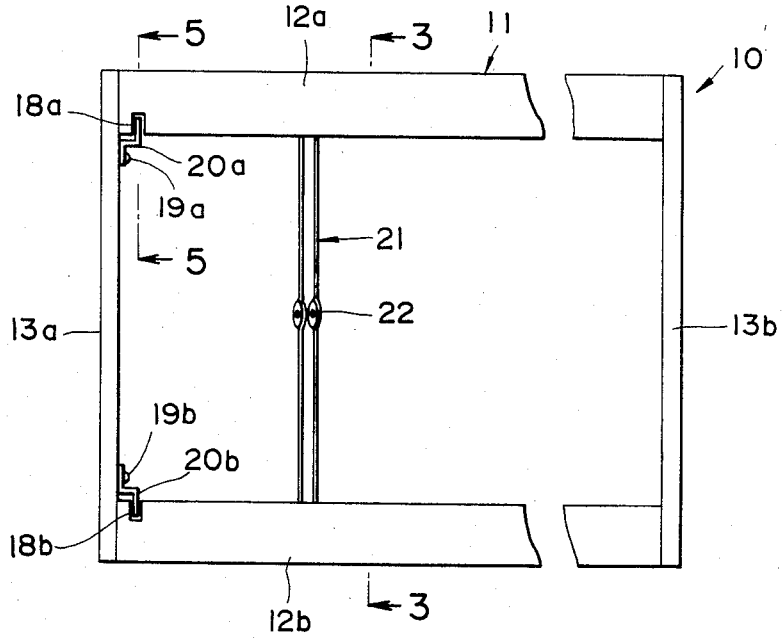
FIG. 2 is a front elevation of a first embodiment of a heald assembly in accordance with the present invention, for use in a loom.

To facilitate understanding the present invention, a brief reference will be made to a conventional heald assembly, depicted in FIG. 1. Referring to FIG. 1, a conventional heald assembly is shown having a heald frame 1 which is constructed of upper and lower laterally elongated beam members 2*a*, 2*b*, and right and left vertically elongated side stays 3*a*, 3*b*. Upper and lower heald bars 4*a*, 4*b* are respectively located slightly spaced apart from the upper and lower beam members 2*a*, 2*b* and secured at their opposite ends to the side stays 3*a*, 3*b* by means of installation members 5. Healds 6 are secured to the upper and lower heald bars 4*a*, 4*b* in a manner to connect the upper and lower heald bars 4*a*, 4*b*. Each heald 6 is formed at its middle part with a mail or eye 7 through which a warp yarn (not shown) passes, and at its opposite ends with loop-shaped installation sections 8*a*, 8*b* in which the upper and lower heald bars 4*a*, 4*b* are disposed, respectively. The heald bars 4*a*, 4*b* are fixedly connected at suitable positions onto the beam members 2*a*, 2*b* by means of so-called middle hooks 9, thereby preventing the deflection of the heald bars 4*a*, 4*b*.

However, in such a conventional heald assembly, the healds 6 freely move within a range of play between the heald bars 4*a*, 4*b* and the installation sections 8*a*, 8*b* of each heald 6 during upward and downward movements of the heald frame 1, thus generating considerable noise due to metal-to-metal contact. Such noise becomes the major source of total loom noise.

To overcome the above-mentioned shortcomings, it has been proposed that the installation sections of the heald onto the heald bars are formed of a plastic material as disclosed in U.S. Pat. No. 4,155,379, thereby decreasing loom noise. However, with such a proposition, heald bars are employed and therefore the heald assembly is heavier in weight by an amount corresponding to the heald bars. Additionally, a heald frame must be enlarged in size by an amount required for installation of the heald bars. These contribute to a total weight increase of the heald assembly, thereby leaving problems in a recent tendency to increase the loom operational speed. Besides, since the healds are installed through the heald bars, production error becomes larger in combining them. As a result, the opening size of the installation section of the heald must be enlarged, thereby increasing the play of the heald. This leads to noticeable wear of the plastic installation sections of each healds, and shortens the life of the healds.

Otherwise, U.S. Pat. No. 3,862,650 discloses that a heald frame is provided at its laterally elongated beam members with rail members which are approximately rhombus shaped in cross-section. The opposite ends of each heald are bifurcated to form two limbs which fit on the rail members so that a plurality of healds are secured to the heald frame. However, in case where the above-mentioned bifurcated limbs are made of a damping material such as plastic material, hard rubber or the like in order to accomplish weightreduction of the healds and noise reduction, a sufficient strength cannot expected in the bifurcated limbs since the thickness of the heald frame is made as small as possible. Accordingly, there is a fear that the bifurcated limbs get out of the rail members attached to the heald frame.

In view of the above description of the conventional heald assemblies, reference is now made to FIGS. 2 to 10, and more specifically to FIGS. 2 to 5, wherein a preferred embodiment of a heald assembly of the present invention is illustrated by the reference numeral 10. The heald assembly 10 comprises a heald frame 11 which is constructed of upper and lower beam members 12*a*, 12*b* which are laterally (horizontally) and parallelly elongated, and side members 13*a*, 13*b* which are vertically and parallelly elongated so as to securely connect the upper and lower beam members 12*a*, 12*b* with each other. In this embodiment, the upper and lower beam members 12*a*, 12*b* are formed respectively with flat faces $F_1$ and $F_2$ which are opposite to or face each other. The upper and lower beam members 12*a*, 12*b* are respectively formed with fitting grooves 14*a*, 14*b* which face to each other. More specifically, the fitting groove 14*a* of the upper beam member 12*a* includes an opening 15*a* which is rectangular in cross-section and elongates along the length of the upper beam member 12*a*. The opening 15*a* is located in the vicinity of the flat face $F_1$. The fitting groove 14*a* further includes a slit 16*a* which is formed by opposite flange sections 17*a*, 17*a* which form at their outer surface the flat face $F_1$. The width $W_1$ of the slit 16*a* is smaller than the width $W_2$ of the opening 15*a*. As shown, the slit 16*a* elongates along the length of the upper beam member 12*a* and merges into the opening 15*a*. Similarly, the fitting groove 14*b* of the lower beam member 12*b* includes an opening 15*b* and a slit 16*b* which is formed by opposite flange sections 17*b*, 17*b* forming at their outer surface the flat face $F_2$. It will be understood that the opening 15*b* and the slit 16*b* of the lower beam member 12*b* are formed similarly to those 15*a*, 16*a* of the upper beam member 12*a*. It will be appreciated that such fitting grooves 14*a*, 14*b* can be formed during an extrusion-process in which aluminum material or the like is formed into the beam member 12*a*, 12*b*.

Additionally, the upper beam member 12*a* is formed with a cut-out groove 18*a* located in the vicinity of its one end in the direction of the length of the upper beam member. The cut-out groove 18*a* is formed on the flat face $F_1$ and extends perpendicularly to the length of the fitting groove 14*a* so as to traverse the fitting groove 14*a*. The cut-out groove 18*a* can be filled with a Z-shaped stop member 20*a* which is securable with a small screw 19*a*.

A plurality of healds 21 are secured to the upper and lower beam members 12*a*, 12*b* in connection with the fitting grooves 14*a*, 14*b* thereof. Each heald 21 includes an elongated metal plate member or head body 21*a* made of stainless steel or the like and formed at its middle section with a mail opening or eye 22 through which a warp yarn (not shown) passes. The heald plate member 21*a* is provided at its opposite ends with installation sections 23*a*, 23*b* which are made of plastic material and formed by injection-molding. Each installation section 23*a*, 23*b* is rectangular in cross-section perpendicular to the length of the fitting groove 14*a*. The width $W_3$ of the installation section 23*a*, 23*b* is larger than that $W_1$ of the slit 16*a*, 16*b*. Furthermore, it is preferable that each end section of the metal plate member 21*a* is formed in the shape which prevents the metal plate member 21*a* from getting out of the plastic installation section 23*a*, 23*b*.

In assembling the heald assembly 10, to install the heald 21 onto the heald frame 11, the installation sections 23*a*, 23*b* are first inserted into the cut-out grooves 18*a*, 18*b* of the upper and lower beam members 12*a*, 12*b* in the state where the stop members 20*a*, 20*b* are removed. Subsequently, when the heald installation sections 23*a*, 23*b* have reached positions coincident with the fitting openings 15*a*, 15*b*, the heald installation sections 23*a*, 23*b* are moved in the direction of the length of the beam members 12*a*, 12*b*. After completion of installation of all the healds 21, the tip section of the stop member 20*a*, 20*b* is projected into the cut-out grooves 18*a*, 18*b*, respectively, so as to fill or close the grooves 18*a*, 18*b*. Then, the stop members 20*a*, 20*b* are secured onto the side member 13*a* by means of the small screws 19*a*, 19*b*.

With the thus arranged heald assembly 10, the heald bars 4*a*, 4*b* and middle hooks 9 in the conventional heald assembly shown in FIG. 1 can be omitted and accordingly the heald assembly is reduced in weight by an amount corresponding to them. Besides, the heald frame can be become small-sized, thereby greatly contributing to a further weight reduction of the heald assembly. Moreover, the installation sections 23*a*, 23*b* of the heald 21 is made of a relatively light-weight damping material such as plastic material, thereby contributing to a further weight reduction of the heald assembly 10. As a result, the heald assembly of the above-discussed type becomes suitable to high-speed looms.

The heald installation sections 23*a*, 23*b* made of plastic material leads to another advantage in which noise generation can be suppressed during striking of the installation sections 23*a*, 23*b* against the wall surface of the fitting grooves 14, 14*b* particularly against the flange sections 17*a*, 17*b* forming therebetween the slits 16*a*, 16*b*, by virtue of damping effect of the plastic material. In other words, a so-called damping-contact (contact under damping action) is maintained between the heald installation section 23*a*, 23*b* and the heald frame beam member 12*a*, 12*b*, thus effectively contributing to noise reduction.

In addition, in the conventional heald assembly shown in FIG. 1, the loop-shaped installation sections 8*a*, 8*b* of the heald 6 are fitted on the heald bars 4*a*, 4*b* which are rectangular in cross-section, and therefore the former are supported on the latter in the state of linear contact therebetween. On the contrary, in the heald assembly of the present invention shown in FIGS. 2 to 5, the heald installation sections 23*a*, 23*b* are in surface-contact with the flange sections 17*a*, 17*b* forming therebetween the slits 16*a*, 16*b*, thus increasing the contact surface area and the support strength.

It will be understood that the installation sections 23*a*, 23*b* of the heald 21 may be made of a relatively light material having damping capacity other than the plastic material, and accordingly made of, for example, hard rubber. While the cut-out grooves 18*a*, 18*b* have been shown and described to be formed on the beam members 12*a*, 12*b* in the the above-mentioned embodiment of the present invention, such cut-out grooves may be omitted in which the side member 13*a* is arranged to be removable so that the installation sections 23*a*, 23*b* of the heald 21 are inserted into the fitting grooves 14*a*, 14*b* after removal of the removable side member. Additionally, it will be appreciated that one of the flange sections 17*a* may be omitted as shown in FIG. 6.

Figure 7:
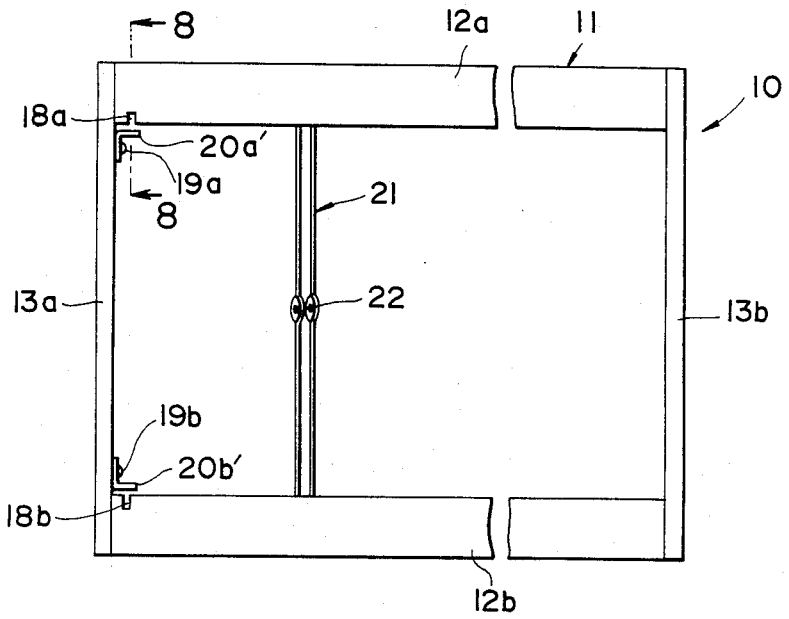
FIG. 7 is a front elevation similar to FIG. 2, but showing another modification of the embodiment of FIG. 1, including another example of a stop member for healds.
Figure 8:
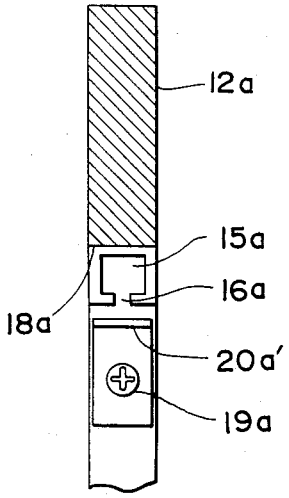
FIG. 8 is a cross-sectional view taken in the direction of arrows substantially along the line 8—8 of FIG. 7.

FIGS. 7 and 8 show another example of the stop member for preventing the heald installation 23*a* from getting out of the beam member 12*a*, 12*b* through the cut-out groove 18*a*, 18*b*. In these figures, the generally L-shaped stop member 20*a*′, 20*b*′ is secured onto the side member 13*a* by means of the small screws 19*a*, 19*b* and located in the vicinity of the cut-out grooves 18*a*, 18*b* so as to cover or close the cut-out grooves 18*a*, 18*b*, respectively.

Figure 9:
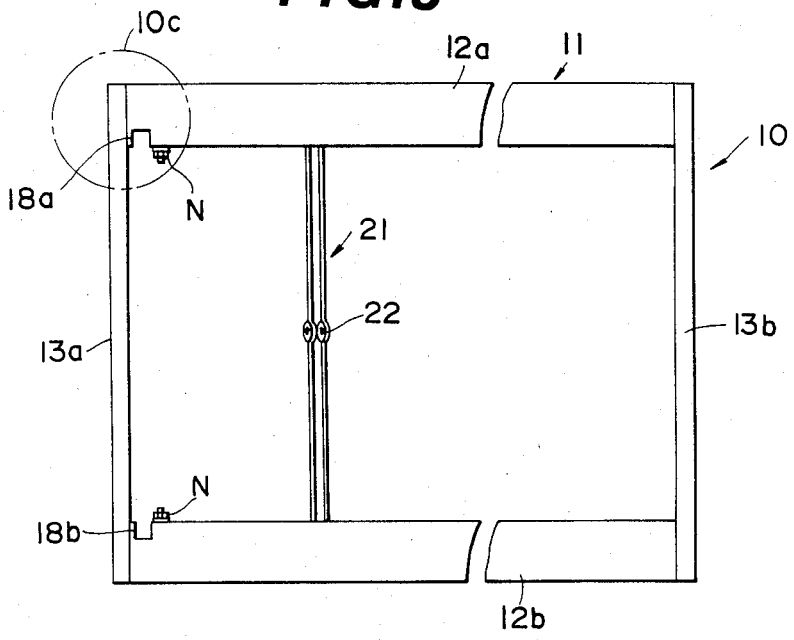
FIG. 9 is a front elevation similar to FIG. 2, but showing a further modification of the embodiment of FIG. 1, including a further example of the stop member.
Figure 10:
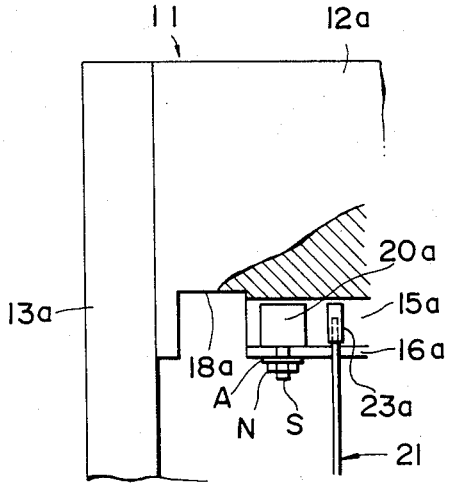
FIG. 10 is an enlarged fragmentary sectional view of a part enclosed by a circle 10C of FIG. 9.

FIGS. 9 and 10 show a further example of the stop member, in which the stop member 20*a*″ is disposed within the fitting opening 15*a*, 15*b* in the vicinity of the cut-out groove 18*a*, 18*b*. The stop member 20*a*″ is integrally provided with a stud bolt S which projects out of the beam members 12*a*, 12*b* through the slits 16*a*, 16*b* and secured through a washer A by means of a nut N located outside the beam member 12*a*, 12*b*.

Embodiments shown in FIGS. 11 to 19 are arranged to prevent each heald 21 from getting out of the slits 16*a*, 16*b* due to the rotation of the heald around its axis in case where the number of healds per unit length is smaller, i.e., heald density is lower.

FIGS. 11 and 12 illustrate a second embodiment of the present invention, in which an elongated projection 31*a* is formed on the upper inner wall surface of the opening 15*a* and located opposite to the slit 16*a*. The projection 31*a* extends along the length of the fitting groove 14*a* and fit in a groove 32*a* which is formed at the upper portion of the installation section 23*a* of the heald 21. Thus, the heald 21 is prevented from rotation around its axis by virtue of fitting of the projection 31*a* in the groove 32*a* of the heald installation section 23*a*. Similarly, the lower beam member 12*b* is also provided with at its opening (15*b*) an inner wall surface with a projection 31*b* which fits in a groove 32*b* formed at the upper portion of the heald installation section 23*b*.

Figure 13:
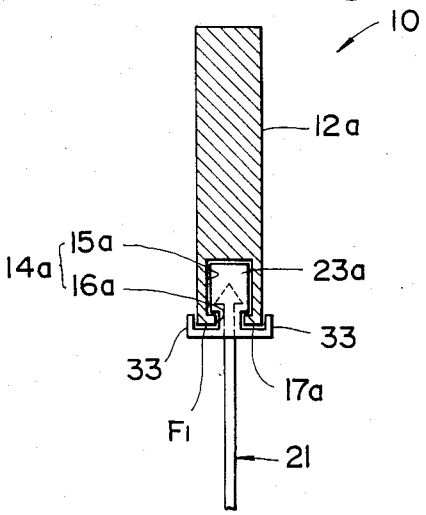
FIG. 13 is a sectional side elevation showing an essential part of a third embodiment of the heald assembly according to the present invention.
Figure 14:
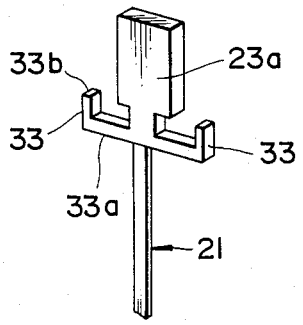
FIG. 14 is a perspective view of a heald installation section in the third embodiment of FIG. 13.

FIGS. 13 and 14 illustrate a third embodiment of the present invention, in which the installation section 23*a* of the heald 21 is integrally formed with oppositely disposed L-shaped support sections 33, 33 which extend in the fore-and-aft direction relative to the beam member 12*a* and to the loom (not shown). In this connection, the installation section 23*a* of the heald 21 is integrally formed with a neck section (no numeral) through which the installation section 23*a* is integrally connected with the L-shaped support sections 33, 33 so that the neck section is located within the slit 16*a*. Each L-shaped support section 33 includes a laterally elongated portion 33*a* which is contactable with the flat face $F_1$ of the upper beam member 12*a*, and a vertically elongated portion 33*b* which is so located that the flange section 17*a* is interposed between the portion 33*b* and the above-mentioned neck section. In other words, the oppositely disposed vertically elongated portions 33*b* rise along opposite side wall surfaces of the upper beam member 12*a*, respectively. With the thus arranged heald 21, the support sections 33, 33 are brought into contact with the surface of the beam member 12*a*, thereby preventing the rotation of the heald 21. It will be understood that one of the support section 33 may be omitted to leave either one of them.

Figure 15:
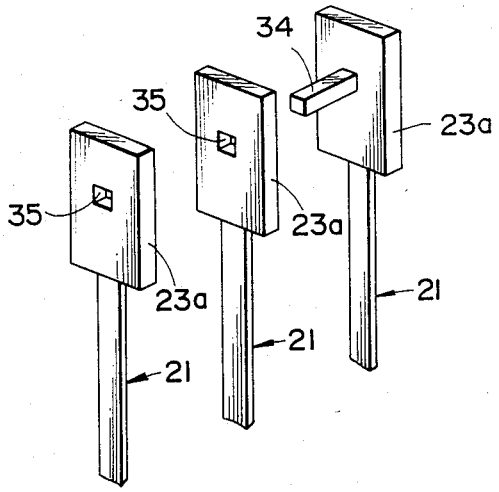
FIG. 15 is a perspective view of a series of heald installation sections showing an essential part of a fourth embodiment of the present invention.

FIG. 15 illustrates a fourth embodiment of the present invention in which several or a set of healds 21 are connected with each other to restrict the movement thereof. In this embodiment, one of the set of healds 21 is provided at its installation section 23*a* with a projection 34 which extends along the length of the fitting groove 14*a*, and the others of the set of the healds are formed at their installation sections 23*a* with through-holes 35, respectively. By inserting the projection 34 into the through-holes 35, the several heald installation sections 23*a* are connected as a single unit, thus preventing the rotation of each heald 21.

Figure 16:
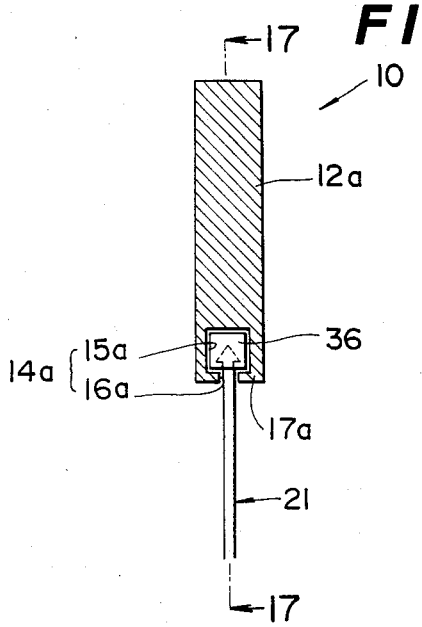
FIG. 16 is a sectional side elevation showing an essential part of a fifth embodiment of the heald assembly according to the present invention.
Figure 17:
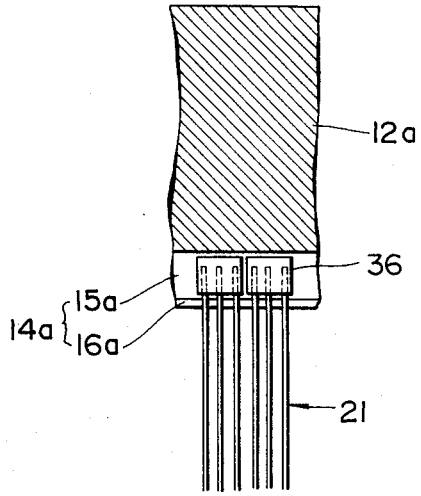
FIG. 17 is a cross-sectional view taken in the direction of arrows substantially along the line 17—17 of FIG. 16.

FIGS. 16 and 17 illustrate a fifth embodiment of the present invention which contemplates to restrict the rotation of the heald 21 by employing a one-piece installation block 36 which serves as a plurality of installation sections of the several healds 21. In this embodiment, the installation block 36 is produced by injection-molding plastic material onto the end sections of the three heald metal plate members 21*a* which are located at certain intervals. Thus, the installation block 36 is considerably large in thickness in the direction along the length of the fitting groove 14*a* as compared with the installation section 23*a* of the heald 21, and accordingly it cannot rotate within the fitting groove 14*a*, thereby effectively preventing each heald from its rotation.

Figure 18:
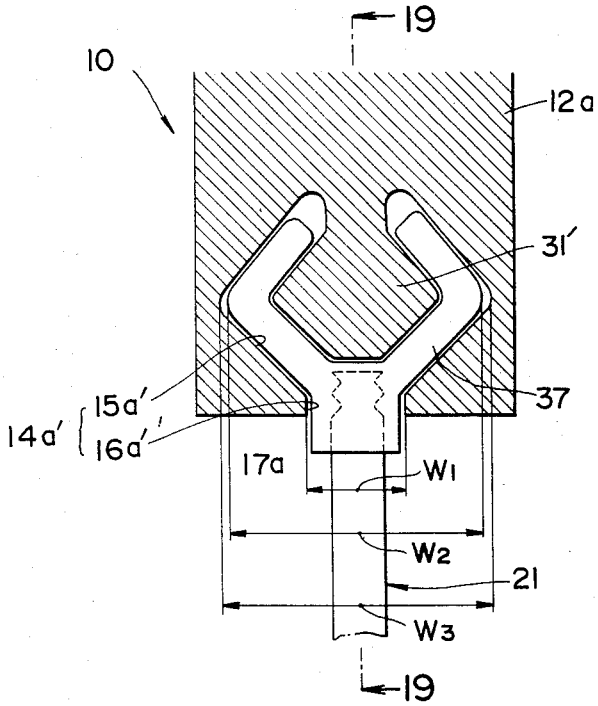
FIG. 18 is an enlarged fragmentary sectional side elevation showing an essential part of a sixth embodiment of the heald assembly according to the present invention.
Figure 19:
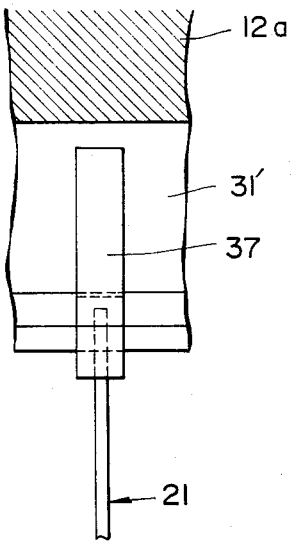
FIG. 19 is a cross-sectional view taken in the direction of arrows substantially along the line 19—19 of FIG. 18.

FIGS. 18 and 19 illustrate a sixth embodiment of the present invention. In this embodiment, the opening 15*a*′, of the fitting groove 14*a*′ is generally rhombus shaped in cross-section. The inner wall surface of the opening 15*a*′ is provided with a projection 31′ which elongates along the length of the fitting groove 14*a*′ and is rhombus shaped in cross-section so as to leave an elongated clearance (no numeral) having the cornered C-shaped cross-section. In this connection, the heald 21 is formed at its end with an installation section 37 which is bifurcated to form two limbs (no numerals) which are generally cornered C-shaped, so that the installation section 37 tightly fits in the above-mentioned elongated clearance. In this embodiment, the width $W_1$ of the slit 16*a*′ is smaller than the widths $W_2$, $W_3$ of the opening 15*a*′ and the heald installation section 37. With this arrangement, even when a downward (in the drawing) force due to the tension of a warp yarn is applied to the heald installation section 37, the generally C-shaped installation section 37 is deflected inwardly by virtue of the inclined inner surface of the flange sections 17*a*′ which forms therebetween the slit 16*a*′. As a result, the upper end part of the two limbs of the installation section 37 is urged to contact with the upper inclined surfaces of the projection 31′, so that a further inward deflection of the installation section 37 cannot be made, thereby effectively preventing the heald 21 from getting out of the fitting groove 14*a*′ while preventing the rotation of the heald by virtue of the projection 31′.

Embodiments discussed hereinafter with reference to FIGS. 20 to 31 are arranged to enable to increase the density of installed healds, i.e., the number of the installed healds per unit length of the heald frame beam member.

Figure 20:
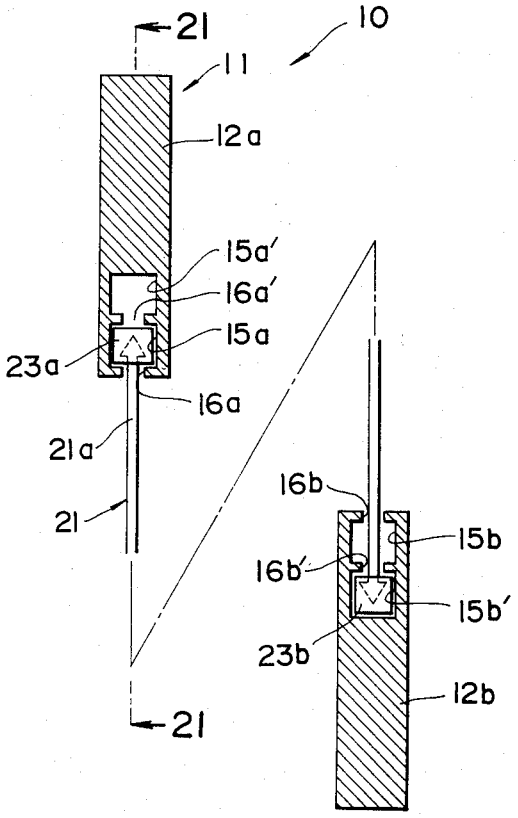
FIG. 20 is a sectional side elevation of a seventh embodiment of the heald assembly according to the present invention.
Figure 21:
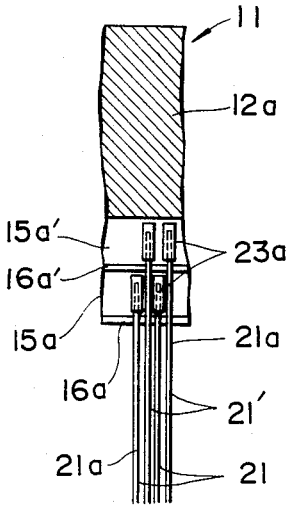
FIG. 21 is a sectional view taken in the direction of arrows substantially along the line 21—21 of FIG. 20.

FIGS. 20 and 21 illustrate a seventh embodiment of the present invention, in which the upper beam member 12*a* is formed with another or additional fitting opening 15*a*′, and another or additional slit 16*a*′. The fitting opening 15*a*′ is located above the fitting opening 15*a* and parallelly extends along the length of the fitting opening 15*a*. The fitting opening 15*a*′ communicates with or merges in the fitting opening 15*a* through the slit 16*a*′ which extends along the length of the both fitting openings 15*a*, 15*a*′. Similarly, the lower beam member 12*b* is formed with another or additional fitting opening 15*b*′ which is located below the fitting opening 15*b* and communicates with or merges in the fitting opening 15*b* through a slit 16*b*′.

In this embodiment, two kinds of or lower and upper healds 21, 21′ are used so that the opposite installation section 23*a*, 23*b* of each heald 21 are disposed within the fitting opening 15*a*, 15*b*′, respectively, while the opposite installation sections 23*a*, 23*b* of each heald 21′ are disposed within the fitting openings 15*a*′ and 15*b*, respectively. Accordingly, if the two kinds of the healds 21, 21′ are alternatively installed in positions side by side as shown in FIG. 21, the metal plate member or heald body 21*a* of each upper heald 21 is interposed between the two installation sections 23*a* of the neighbouring lower healds, thus making possible a heald installation in the most high density. As shown, the metal plate member 21*a* of each upper heald 21′ extends through within the slits 16*a*′, *16a*, 16*b*, 16*b*′ of the upper and lower beam members 12*a*, 12*b*. It will be understood that the same kind of two healds may be located side by side, and subsequently the other kind of one or two healds are located by the above two healds, in which the number of the same kind of healds located side by side are selected in accordance with a required density of the installed healds.

Figure 22:
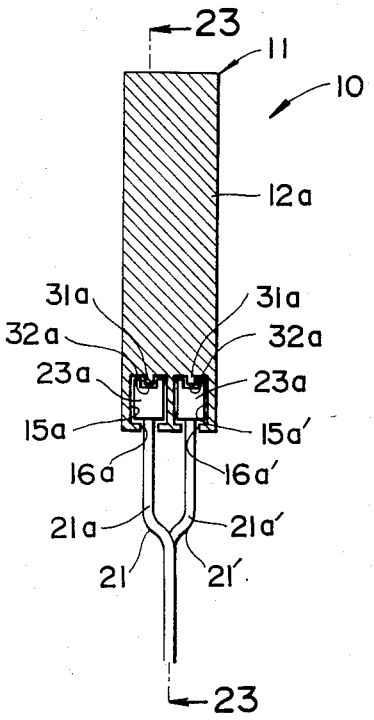
FIG. 22 is a sectional side elevation showing an essential part of an eighth embodiment of the heald assembly according to the present invention.
Figure 23:
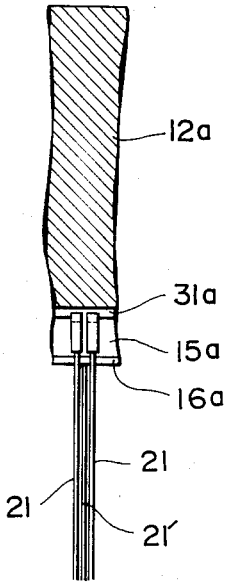
FIG. 23 is a sectional view taken in the direction of arrows substantially along the line 23—23 of FIG. 22.

FIGS. 22 and 23 illustrate an eighth embodiment of the present invention. In this embodiment, the additional fitting opening 15a' is formed by the fitting opening 15a and extends parallelly with the fitting opening 15a, so that the both fitting openings 15a, 15a' are located side by side and accordingly the slits 16a, 16a' are also located side by side. In this connection, the installation sections 23a of healds 21, 21' are located within the fitting openings 15a, 15a', respectively. Additionally, the metal plate members 21a, 21a' extend through the slits 16a, 16a', respectively. The heald metal plate members 21a, 21a' are so curved as to overlap each other at their middle sections having the eye (22) as shown in FIG. 22. It will be understood that the density of the installed heald can be increased only with a limitation due to the thickness of the metal plate members 21a, 21a'.

Figure 24:
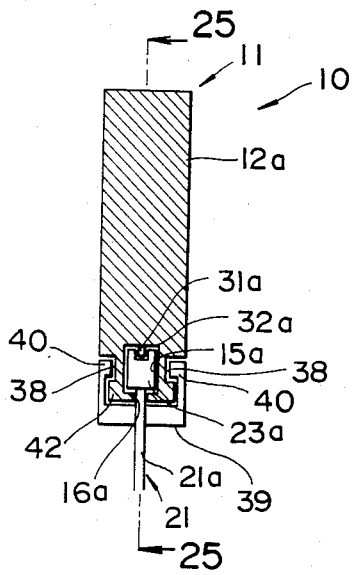
FIG. 24 is a sectional side elevation showing an essential part of a ninth embodiment of the heald assembly according to the present invention.
Figure 25:
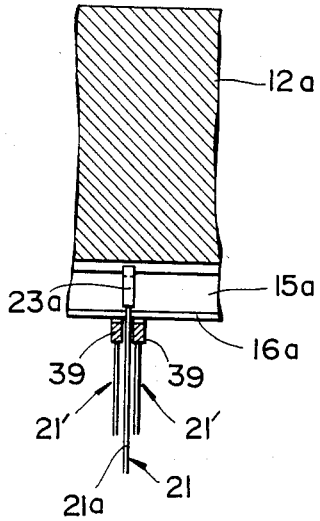
FIG. 25 is a sectional view taken in the direction of arrows substantially along the line 25—25 of FIG. 24.
Figure 26:
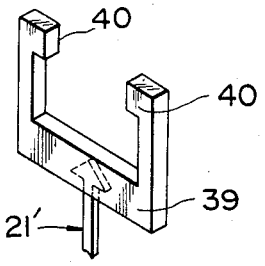
FIG. 26 is a perspective view of a part of one of two kinds of healds used in the heald assembly of FIG. 24.

FIGS. 24 to 26 illustrate a ninth embodiment according of the present invention, in which the upper heald frame beam member 12a is formed at its opposite side wall surfaces with oppositely located grooves 38 in a manner that the fitting opening 15a is located between the grooves 38, 38. In this connection, each heald 21' has an installation section 39 which is generally covered C-shaped and formed at its upper section with fitting projections 40, 40. The fitting projections 40, 40 fit in the grooves 38, 38 of the upper beam member 12a, respectively, as clearly shown in FIG. 24. The upper beam member 12a is formed at its lower-most section with oppositely disposed shorter projections 42 which fit in the inner surface of the generally C-shaped heald installation section 39. Thus, each heald 21' is installed in such a manner that the installation section 39 thereof is interposed between the metal plate members 21a, 21a of the healds 21, 21, thereby effectively increasing the density of the healds 21, 21' installed onto the heald frame 11.

Figure 27:
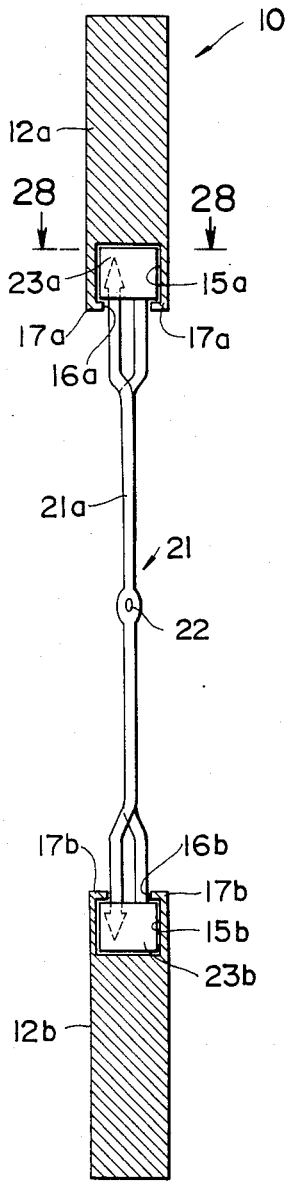
FIG. 27 is a sectional side elevation of a tenth embodiment of the heald assembly according to the present invention.
Figure 28:
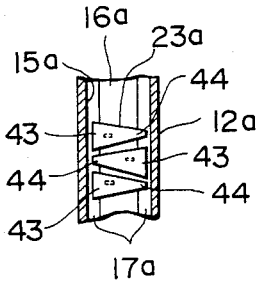
FIG. 28 is a fragmentary sectional view taken in the direction of arrows substantially along the line 28—28 of FIG. 27.

FIGS. 27 and 28 illustrate a tenth embodiment of the present invention, wherein each installation section 23a, 23b of each heald 21 is generally wedge-shaped so as to have one end part 43 which is larger in thickness than the other end part 44 as viewed from the direction of the axis of the metal plate member 21a of each heald 21. In other words, the thickness of the heald installation section 23a, 23b varies in the direction traversing at right angles the fitting opening 15a, 15b. Additionally, the heald metal plate member 21a is disposed one-sided in the heald installation section 23a, 23b, i.e., embedded in the thicker end part 43 of each heald installation section 23a. Thus, in order to install the healds 21 onto the heald frame 11, the heald installation sections 23a (23b) are so positioned that the thicker and thinner end parts 43, 44 lie side by side or face to each other as shown in FIG. 28. It will be understood that the thicker end parts 43 of the heald installation sections 23a, 23b are not located side by side and therefore the density of the installed healds 21 is effectively increased. As shown, in this embodiment, the heald metal plate members 21a are curved so that their middle section having the eye 22 overlap each other as viewed from the direction of the length of the heald frame beam members 12a, 12b.

Figure 29:
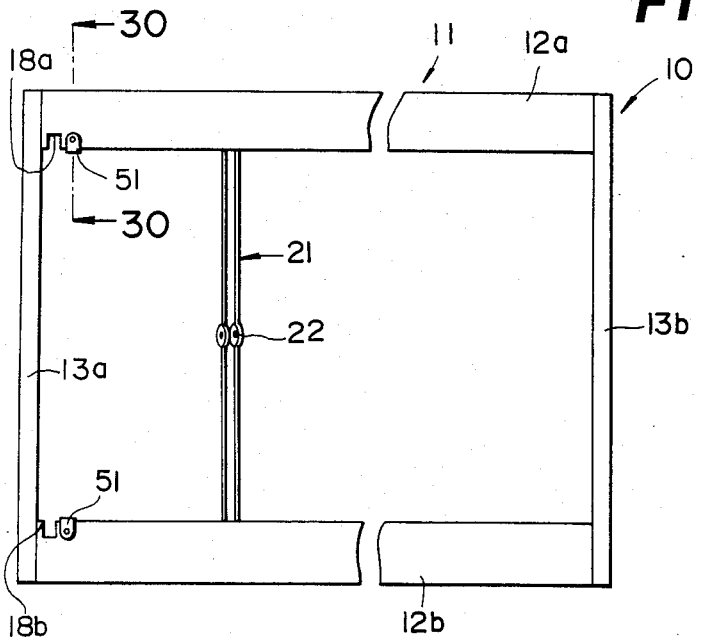
FIG. 29 is a front elevation of the heald assembly of the embodiment of FIG. 27.
Figure 30:
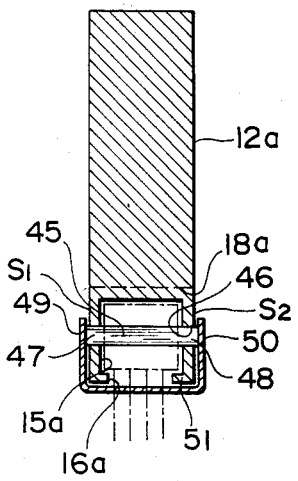
FIG. 30 is a sectional view taken in the direction of arrows substantially along the line 30—30 of FIG. 29.

As shown in FIGS. 29 and 30, a stop pin 45 is provided to prevent the heald installation sections 23a from getting out of the fitting opening 15a. The stop pin 45 is disposed within a through-hole 46 formed through opposite walls $S_1$, $S_2$, defining therebetween the fitting opening 15a of the upper beam member 12a. As shown, the opposite end sections 47, 48 project out of the walls $S_1$, $S_2$ and fit in openings 49, 50 of a generally C-shaped pin support member 51 made of a resilient material. The pin support member 51 is detachable by elastically bending it.

Figure 31:
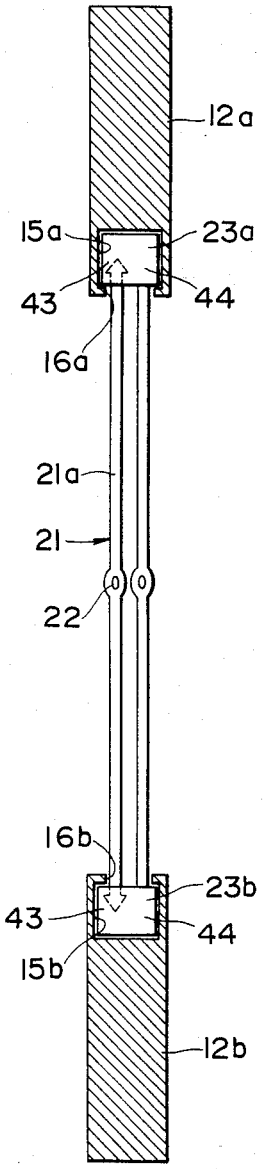
FIG. 31 is a sectional side elevation similar to FIG. 27, but showing a modified example of the tenth embodiment of FIG. 27.

FIG. 31 shows a modified example of the embodiment of FIGS. 27 to 29, in which the straight elongated metal plate member 21a is used to be embedded in the thicker part 43 of each heald installation section 23a, in place of the curved one in the embodiment of FIGS. 27 to 29. In this instance, the locations of the eyes 22 are alternately spaced from each other in the fore-and-aft direction; however, no shortcomings arise while providing an advantage from a point of view of increasing the density of the installed healds.

Figure 32:
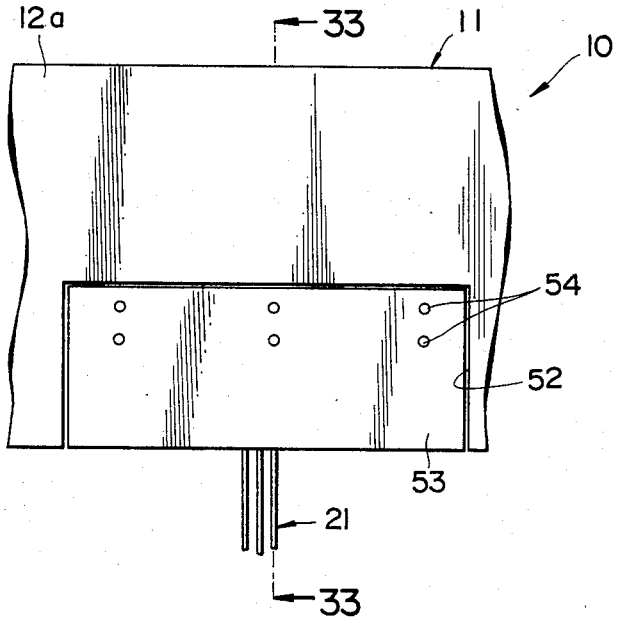
FIG. 32 is a fragmentary front elevation of an eleventh embodiment of the heald assembly according to the present invention.
Figure 33:
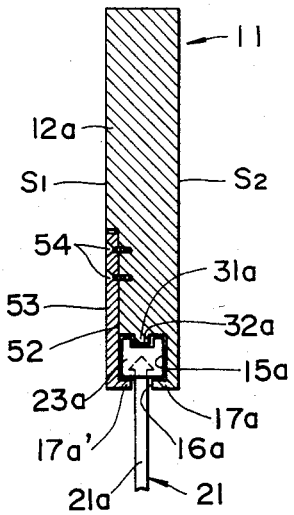
FIG. 33 is a sectional view taken in the direction of arrows substantially along the line 33—33 of FIG. 32.

FIGS. 32 and 33 illustrate an eleventh embodiment of the present invention. In this embodiment, the upper heald beam member 12a is formed at one of the opposite side wall surfaces $S_1$, $S_2$ with a rectangular opening 52 which is formed by cutting out a part of the side wall surface $S_1$. The opening 52 merges in the fitting opening 15a and is filled with a rectangular plate member 53 which is secured in position by means of small screws 54. As shown, the plate member 53 extends downwardly to form the lower-most part of the beam member 12a. Accordingly, the plate member 53 is formed at its bottom section with a flange section 17a' which is located opposite to the flange section 17a so as to define therebetween the slit 16a. Additionally, a lower part of the inner wall surface of the plate member 53 serves as the wall surface which defines thereinside the fitting opening 15a.

In order to install the healds 21 onto the heald frame 11 in this embodiment, after removal of the plate member 53, the heald installation sections 23a are inserted through the rectangular opening 52 to be fitted in the fitting opening 23a. When the installation of all the healds 21 is completed, the plate member 53 is fixed onto the heald beam member 12a by the small screws 54 so as to close the rectangular opening 52. It will be understood that a similar arrangement including the rectangular opening 52 and the plate member 53 is employed in the lower heald beam member 12b though not shown.

With the thus arranged heald beam member structure, the installation and removal of the healds 21 can be accomplished only by removing the plate member 53 from the heald beam member, thus facilitating the operation of installation and removal of the healds 21. Besides, if a plurality of the above-mentioned openings 52 are formed at certain intervals along the length of the heald beam member 12a, it is possible to remove a single heald located at a particular position. It will be appreciated that the rectangular opening 52 may be formed throughout approximately the whole length of the heald beam member.

Figure 34:
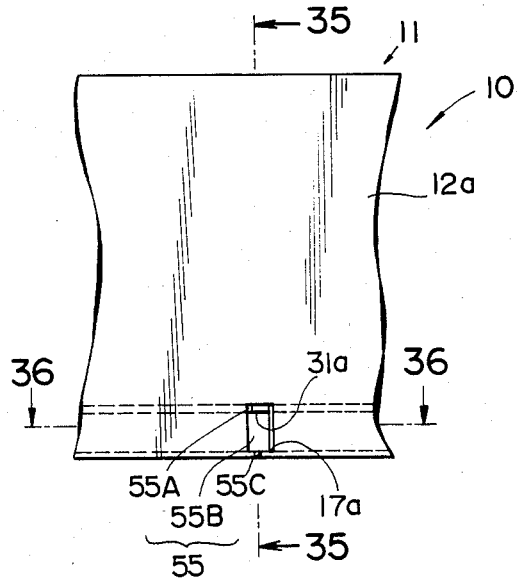
FIG. 34 is a fragmentary front elevation of a heald frame beam member of a twelfth embodiment of the heald assembly in accordance with the present invention.
Figure 35:
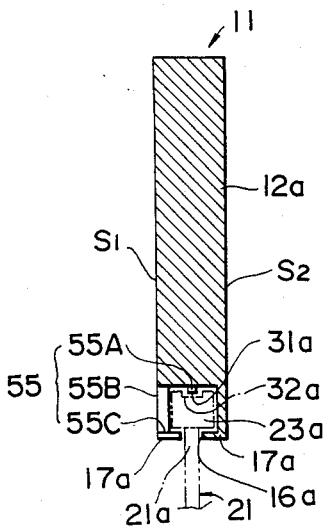
FIG. 35 is a sectional view taken in the direction of arrows substantially along the line 35—35 of FIG. 34.
Figure 36:
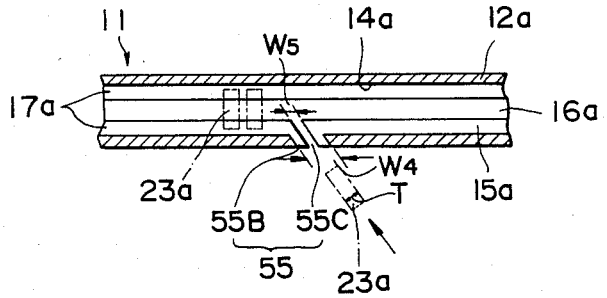
FIG. 36 is a sectional view taken in the direction of arrows substantially along the line 36—36 of FIG. 34.
Figure 37:
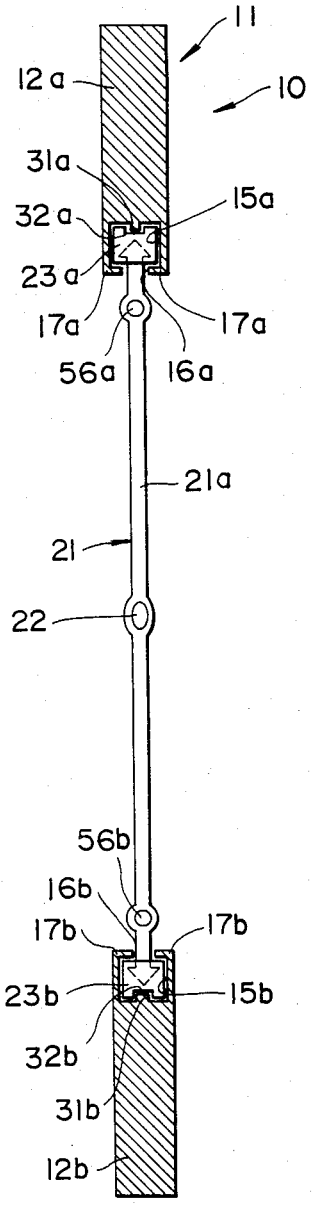
FIG. 37 is a sectional side elevation of a thirteenth embodiment of the heald assembly in accordance with the present invention.
Figure 38:
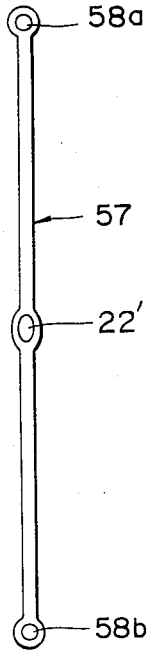
FIG. 38 is a sectional side elevation of each auxiliary heald for repairing, used in the embodiment of FIG. 37.

FIGS. 34 to 36 illustrate a twelfth embodiment of the present invention, in which the upper heald beam member 12a is formed at its one side wall surface $S_1$ with a plurality of heald inserting openings 55 which are located at suitable intervals, for example, of 100 to 200 mm along the length of the heald beam member 12a, though only one heald inserting opening 55 is shown in the drawing. Each heald inserting opening 55 is formed to obliquely traverse one side wall (including the surface $S_1$), the elongated projection 31a, and the fitting flange section 17a, i.e., formed in the direction to obliquely intersect the axis of the fitting groove 14a.

The heald inserting opening 55 includes an upper section 55A formed through the elongated projection 31*a*, a middle section 55B through which the heald installation 23*a* is inserted, and a lower section 55C through which the metal plate member or heald body 21*a* is inserted. Accordingly, the width $W_4$ of the heald inserting opening middle section 55B is larger than the thickness T of the heald installation section 23*a* while the width $W_5$ of the lower section 55C is smaller than the above-thickness T, so that the heald installation section 23*a* cannot enter the heald inserting opening lower section 55C.

To install the healds 21 onto the heald frame 11, the heald installation section 23*a* is first put into the heald inserting opening middle section 55B while putting the heald metal plate member 21*a* in the lower section 55C. Then, the heald installation section 23*a* is pushed obliquely along the heald inserting opening middle section 55B. As a result, the heald installation section 23*a* traverses also the projection 31*a* along the opening upper section 55A and reaches a position where the heald metal plate member 21*a* is located within the slit 16*a*. Subsequently, the heald 21 is rotated around its axis and moved in the direction of the axis of the fitting groove 14*a* so that the groove 32*a* of the heald installation section 23*a* engages with the elongated projection 31*a*. Therefore, the heald installation section 23*a* fits in the fitting opening 15*a* to complete heald installation operation. In order to remove the heald 21, it is sufficient to bring the heald installation section 23*a* into agreement with the heald inserting opening 55 and then draw it out, in a topsy-turvy manner to the above.

Although this embodiment is apprehensive of the fact that the heald installation section 23*a* naturally rotates due to upward and downward movements of the heald frame 11 thereby becoming parallel with the length of the heald inserting opening 55, the heald 21 is prevented from its rotation by the force due to the tension of the warp yarn passing through the heald eye (not shown) during loom operation for weaving and therefore the healds do not get out of the heald frame 11.

With the thus arranged heald beam member structure, the installation and removal of the heald can be easily accomplished. Besides, since a plurality of the heald inserting openings 55 are located at suitable intervals along the length of the heald beam member 12*a*, only a broken heald can be easily removed through the heald inserting opening 55 by slightly moving the healds 21 in the vicinity of the heald inserting opening 55 along the length of the fitting groove 14*a* in case where one of many healds is broken, thus facilitating the replacement of the broken heald with a new one.

FIGS. 37 to 40 illustrate a thirteenth embodiment of the present invention which is so arranged that a if broken heald (particularly broken at its installation section) can be temporarily replaced with an auxiliary heald 57. In this embodiment, the metal plate member or heald body 21*a* of each heald 21 is formed with upper and lower openings 56*a*, 56*b* which are located respectively in the vicinity of the upper and lower heald installation sections 23*a*, 23*b*. In this connection, the auxiliary heald 57 is made of stainless steel or the like and is formed at its opposite ends with upper and lower openings 58*a*, 58*b* which correspond to the openings 56*a*, 56*b* of the heald 21, respectively. Additionally, the auxiliary heald 57 is also formed at its middle section with the eye 22' through which the warp yarn (not shown) passes. It is to be noted that this auxiliary heald 57 is not provided with its installation section to be located in the fitting opening 15*a*, and therefore it is shorter by the length of the installation section than the normal heald 21.

Figure 39:
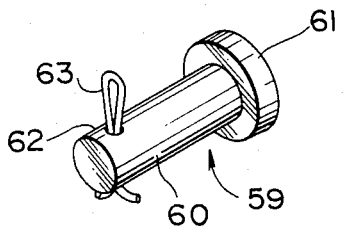
FIG. 39 is a perspective view of a support pin used in the thirteenth embodiment.

A support pin 59 shown in FIG. 39 is provided to connect the heald 21 and the auxiliary heald 57. The support pin 59 has a small-diameter section 60 which is insertable into the opening 56*a*, 56*b* of the heald 21 and the opening 58*a*, 58*b* of the auxiliary heald 57. Furthermore, the support pin 59 is provided at its one end of the small-diameter section 60 with a large-diameter section 61 which serves as a stopper. The small-diameter section 60 is formed with a through-hole 62 in which a split pin 63 is insertable.

With this arrangement, when one of the healds 21 is broken, the broken heald 21 is removed and then the auxiliary heald 57 is located at the position of the removed heald 21. Subsequently, the small-diameter section 60 of the support pin 59 is inserted into the openings 56*a* (56*b*) of the two healds 21 between which the auxiliary heald 57 is located, and then the split pin 63 is inserted into the through-hole 62, the free ends of the split pin 63 being bent in the opposite directions. Thus, the auxiliary heald 57 is securely supported through the support pin 59 by the two healds 21 to function the same as the normal healds 21, so that the warp yarn is passed through the eye 22' thereof.

Figure 41:
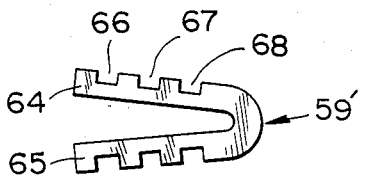
FIG. 41 is a side view of another modified example of the support pin usable in the thirteenth embodiment.

FIG. 41 shows another example of the support pin 59' which is usable in place of the above-mentioned support pin 59. The support pin 59' is made of a resilient material and formed V-shaped so as to have two opposite elongated sections 64, 65. Each elongated section 64, 65 is formed with three grooves 66, 67, 68. In order to install this support pin 51 in position, the free ends of the two elongated sections 64, 65 of the support pin 59' are so pressed as to approach to each other by the fingers of an operator (not shown). Then, the support pin 59' is inserted into the openings 56*a* (56*b*) of the two healds 21 and the opening 58*a* (58*b*) of the auxiliary heald 57. In this state, the support pin 59' expands by virtue of its elasticity so that the distance between the free ends of the two elongated sections 64, 65 is enlarged. As a result, the three grooves 66, 67, 68 of the support pin 59' fit in the opening 56*a* (56*b*), 58*a* (58*b*), 56*a* (56*b*), respectively, thereby preventing the support pin from getting out of the healds 21 and the auxiliary heald 57.

Figure 42:
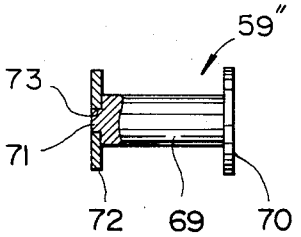
FIG. 42 a side view, partly in section, of a further modified example of the support pin usable in the thirteenth embodiment.
Figure 40:
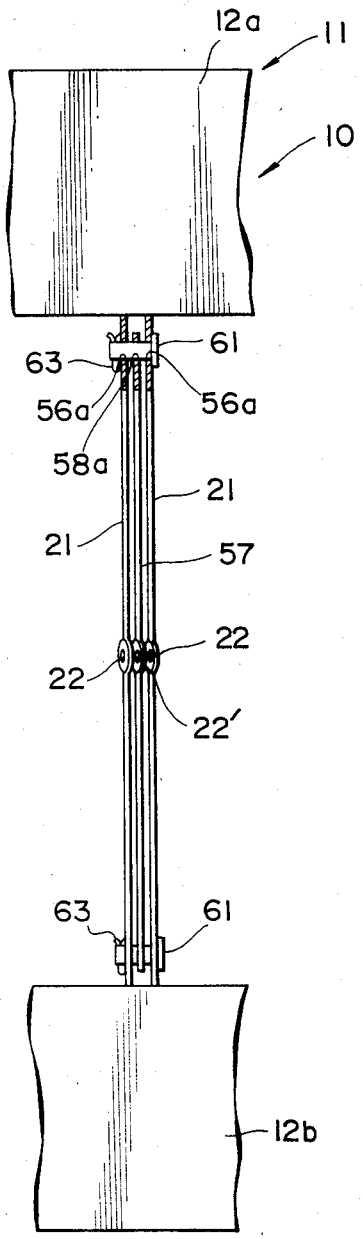
FIG. 40 is a front elevation, partly in section, of the completed heald assembly of the thirteenth embodiment.

FIG. 42 shows a further example of the support pin denoted by the reference numeral 59''. In this example, the support pin 59'' has small-diameter and large-diameter sections 69, 70 which are similar to those 60, 61 in the example of FIG. 39. Additionally, the support pin 59'' is provided at its end with a projection 71 on which a disc-type stopper 72 is securely mounted through an opening 73 located at the central portion of the stopper 72, by using adhesive or the like. In the embodiment of FIGS. 37 to 42, the auxiliary heald 57 may be unnecessary to be prepared, because the broken heald 21 can be used as the auxiliary heald 57, after the installation sections 23*a*, 23*b* of the broken heald 21 are cut away.

Figure 43A:
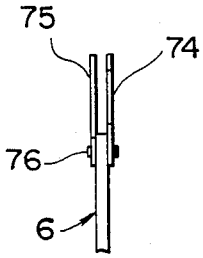
FIG.43A PRIOR ART
FIGS. 43A and 43B are front and side views of a conventional temporary repairing device for a broken heald, used in a prior art heald assembly of FIG. 1.
Figure 43B:
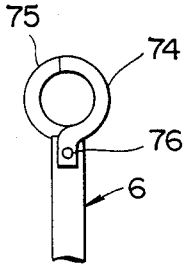
FIG.43B PRIOR ART

It will be appreciated that according to embodiment of FIGS. 37 to 42, temporary repairing of broken healds becomes facilitated, thereby greatly improving the operational efficiency of looms. On the contrary, with the conventional heald assembly shown in FIG. 1, the broken installation sections 8*a*, 8*b* are cut away and then, as shown in FIGS. 43A, 43B, provided on the opposite side surfaces of each cut end with two C-shaped metal members 74, 75 which are located oppositely in a manner shown in FIG. 43B. The C-shaped metal members 74, 75 are fixed by rivets or the like passing through an opening (no numeral) formed at each cut end of the broken heald 6. It will be understood that such repairing operation is very troublesome.

Figure 44:
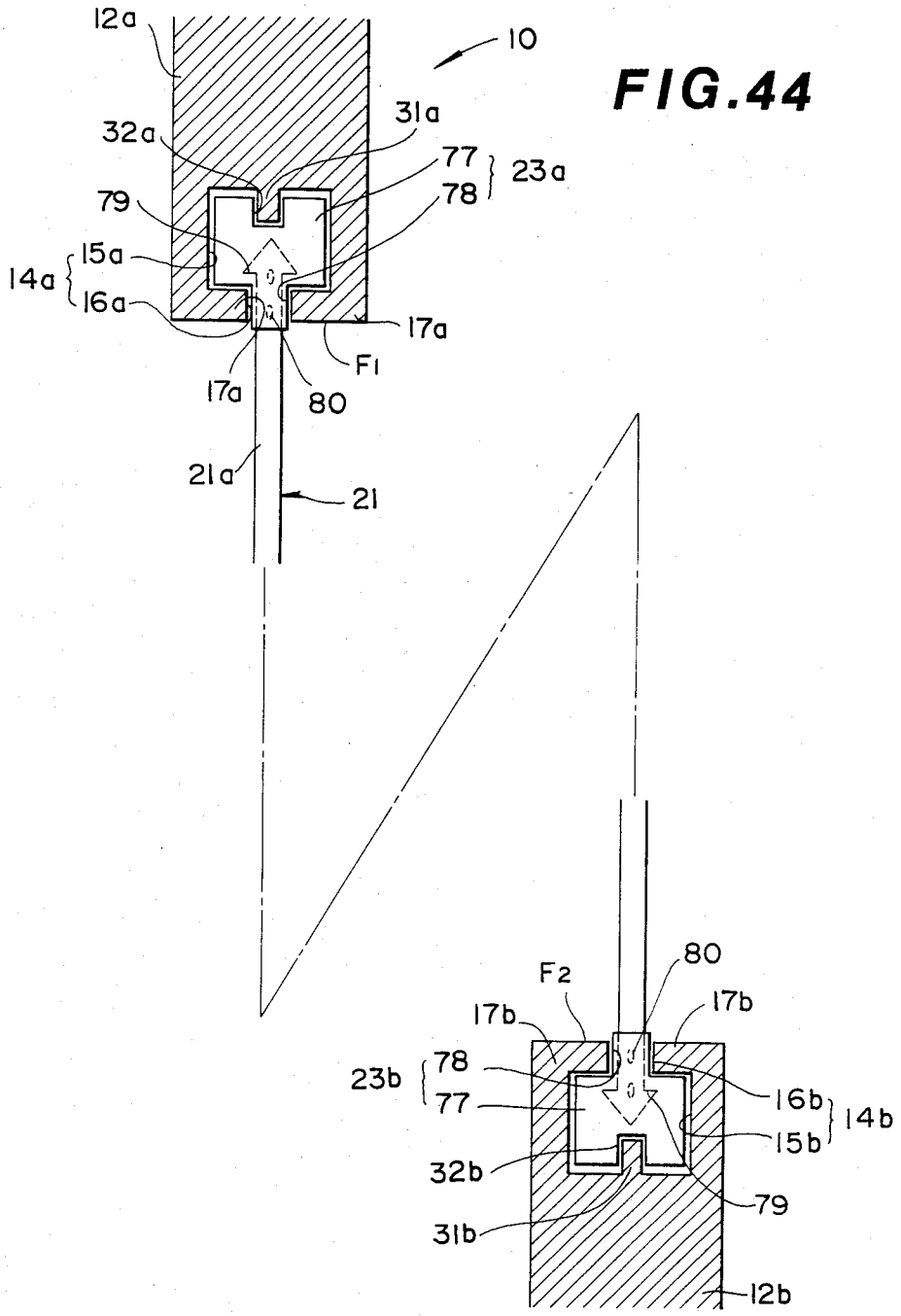
FIG. 44 is a fragmentary sectional side elevation of a fourteenth embodiment of the heald assembly in accordance with the present invention.

FIG. 44 illustrates a fourteenth embodiment of the present invention, in which the heald installation sections 23*a*, 23*b* are formed by injection-molding of plastic material. Each heald installation section 23*a*, 23*b* includes a main body part 77 which is generally rectangular in cross-section and located within the fitting opening 15*a*, 15*b*. Additionally, the installation section 23*a* further includes a vertically elongated section 78 which is integral with the main body part 77. The vertically elongated part 78 covers a part of the heald metal plate member 21*a* and extends through the slit 16*a*, 16*b* beyond the inner faces $F_1$, $F_2$ of the heald beam member 12*a*, 12*b*, i.e., extends outside of the slit 17*a*, 17*b*. Each of the opposite end sections of the metal plate member 21*a* is formed with jaw-like portions 79 and openings 80 in order to prevent the metal plate member 21*a*, 21*b* from getting out of the heald installation section 23*a*, 23*b*. It will be understood that the openings 80 of the heald metal plate member 21*a* is filled with hardened plastic material and accordingly the thus filled plastic material serves as pins passing through the heald metal plate member 21*a*.

Thus, in this embodiment, the heald metal plate member 21*a* located within the slit 16*a*, 16*b* is covered with a material having a damping capacity and consequently wear is made in the vertically elongated part 78 of the heald installation section 23*a* rather than in the flange sections 17*a* (17*b*) of heald frame beam member 12*a*, thereby improving the durability and life of the heald frame 11.

Figure 45:
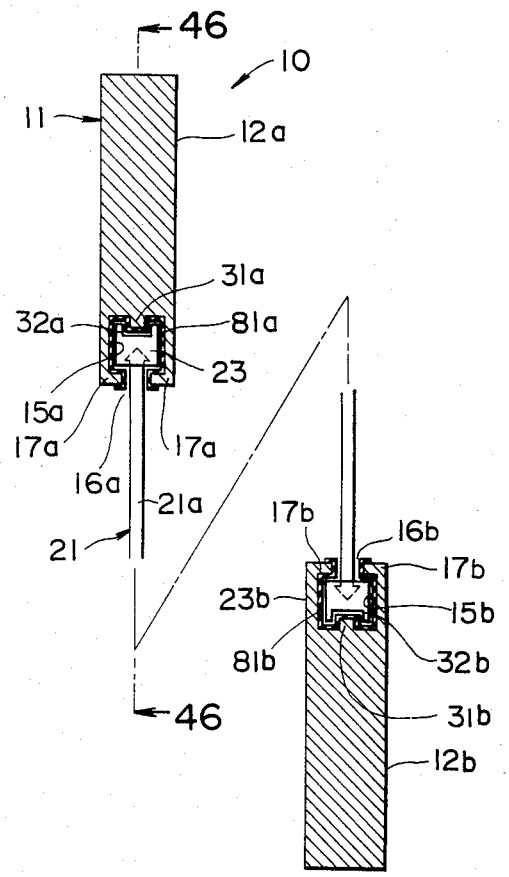
FIG. 45 is a sectional side elevation of a fifteenth embodiment of the heald assembly in accordance with the present invention.
Figure 46:
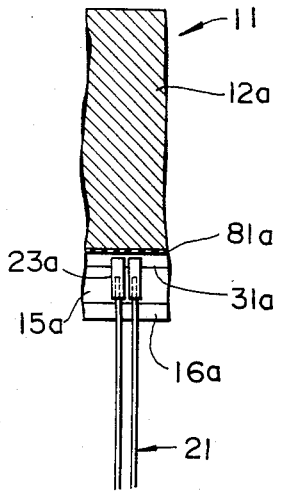
FIG. 46 is a sectional view taken in the direction of arrows substantially along the line 46—46 of FIG. 45.
Figure 47:
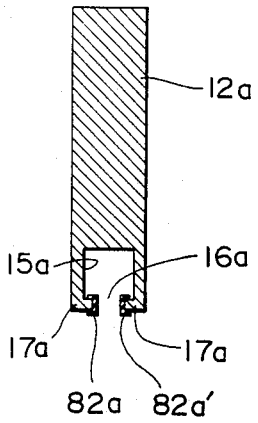
FIG. 47 is a sectional side elevation showing an essential part of a modified example of the fifteenth embodiment.

FIGS. 45 and 46 illustrates a fifteenth embodiment of the present invention. In this embodiment, the heald installation sections 23*a*, 23*b* are made of light metal such as aluminium or magnesium. In this connection, the inner surface of the fitting groove 14*a*, 14*b* of the heald frame beam member 12*a*, 12*b* is covered with a damping layer 81*a*, 81*b* made of a material having damping capacity, for example, plastic material, hard rubber or the like, thereby providing damping action between the metal heald installation section 23*a*, 23*b* and the metal heald frame beam member 12*a*, 12*b*. As shown, the damping layer 81*a*, 81*b* is press-fitted in position and supplied along the shape of the inner surface of the fitting groove 14*a*, 14*b* which includes the fitting opening 15*a*, 15*b*, and the slit 16*a*, 16*b*. Accordingly, the damping layer 81*a*, 81*b* also covers the opposite surfaces of the flange sections 17*a*, 17*a*; 17*b*, 17*b* defining therebetween the slit 16*a*, 16*b*. Otherwise, as shown in FIG. 47, the above-mentioned damping layer 81*a* may be replaced with damping layers 82*a*, 82*a*', generally C-shaped in cross-section, which are located to cover the inner wall surface of the slit 16*a*, i.e., to cover the tip part of each flange section 17*a*. This can also provide a sufficient damping action because the heald installation section 23*a* strikes mainly against the flange sections 17*a*, 17*a* during upward and downward movements of the heald frame 11.

What is claimed is:

1. A heald assembly of a loom comprising:

a heald frame including first and second straight elongated beam members, said first beam member being located over said second beam member, said first and second beam members being respectively formed with first and second inner faces which face to each other;

means defining first and second straight elongated openings in said first and second beam members, respectively, each elongated opening extending along the length of the corresponding beam member, said means forming part of said heald frame first and second beam members;

means defining first and second straight elongated slits on said first and second inner faces, each elongated slit extending along the length of the corresponding beam member, said first and second elongated slits merging in said first and second elongated openings, respectively, each elongated slit being smaller in width than the corresponding elongated opening;

a plurality of healds each including an elongated one-piece heald body, and first and second installation sections secured at the opposite end portions of said heald body to form each heald substantially into a one-piece structure, said first and second installation sections being disposed respectively within said first and second elongated openings so that a part of said heald body is located within each elongated slit, each heald installation section being larger in width than said elongated slit;

means preventing metal-to-metal contact between said heald installation section and said heald frame beam member;

means maintaining surface-to-surface contact between each heald installation section and said means defining first and second straight elongated openings, said surface-to-surface contact maintaining means including at least a flat inner wall surface of each heald frame beam member to define said straight elongated opening, and at least a flat peripheral surface of each heald installation section which peripheral surface is substantially parallel and contactable with said heald frame member inner wall surface; and means for preventing rotation of said heald around its axis under cooperation of said heald frame beam members and said heald installation sections.

2. A heald assembly as claimed in claim 1, wherein said damping-contact maintaining means includes said heald installation section made of a material having damping capacity, in which each heald frame beam member is made of metal.

3. A heald assembly as claimed in claim 2, wherein said material is one selected from the group consisting of plastic material and hard rubber.

4. A heald assembly as claimed in claim 1, wherein said heald body is made of metal.

5. A heald assembly as claimed in claim 4, wherein said metal is stainless steel.

6. A heald assembly as claimed in claim 1, wherein each of the opposite end portions of said heald body is formed with a laterally projected section for preventing said heald body from getting out of said heald installation section.

7. A heald assembly as claimed in claim 1 wherein said rotation preventing means includes a straight elongated projection formed on the inner wall surface of said elongated opening and extending along the length of said beam member, said elongated projection being located opposite to said elongated slit and fitting in a groove formed on said heald installation section.

8. A heald assembly as claimed in claim 1, wherein said rotation preventing means includes a movement restriction section connected to said heald installation section, said restriction section extending along said beam member inner face and being formed with a portion in contact with the wall surface of said heald frame beam member.

9. A heald assembly as claimed in claim 1, wherein said rotation preventing means includes means for securely connecting a plurality of said healds with each other.

10. A heald assembly as claimed in claim 9, wherein said connecting means includes a projection formed on the surface of said heald installation section and extending along the length of said heald beam member, said projection being disposed within respective through-holes of a plurality of heald installation sections.

11. A heald assembly as claimed in claim 1, further comprising means for facilitating the installation and removal of said healds relative to said heald frame.

12. A heald assembly as claimed in claim 11, wherein said facilitating means includes means defining an opening on one of opposite side walls of said heald frame beam member, said opening merging in said straight elongated opening of said heald frame beam member, and a plate member detachably fitting in said opening.

13. A heald assembly as claimed in claim 12, wherein said facilitating means includes means defining a heald inserting opening formed in said heald frame beam member and having a first section merging in said straight elongated opening and obliquely intersecting said straight elongated opening, and a second section merging in said straight elongated slit and extending parallelly with said first section, whereby said heald installation section and said heald body are inserted through said first and second sections into said straight elongated opening and said straight elongated slit, respectively.

14. A heald assembly as claimed in claim 13, wherein the width of said heald inserting opening first section is larger than the thickness of said heald installation section, while the width of said heald inserting opening second section is smaller than the thickness of the said heald installation section.

15. A heald assembly as claimed in claim 1, wherein said heald installation section includes a main body part located within said straight elongated opening of said heald frame beam member, and an elongated part integral with said main body part and covering a part of said elongated heald body, said elongated part being located within said straight elongated slit and extending along the length of said elongated heald body.

16. A heald assembly as claimed in claim 15, wherein each of the opposite end portions of said heald body is formed with jaw-like sections which are laterally projected, and openings which are filled with a material of the heald installation section, whereby the heald body is prevented from getting out of said heald installation section.

17. A heald assembly as claimed in claim 1, wherein said metal-to-metal contact preventing means includes a damping layer disposed to cover at least the tip part of two opposite flange sections of said heald frame beam member which flange sections define therebetween said straight elongated slit, said damping layer being made of a material having damping capacity.

18. A head assembly as claimed in claim 17, wherein said damping layer is disposed to cover the inner wall surface defining said straight elongated opening and the inner wall surface defining said straight elongated slit of said heald frame beam member.

19. A heald assembly as claimed in claim 1, wherein said rotation preventing means includes first engaging means formed at said flat inner wall surface of each heald frame beam member, and second engaging means formed at said flat peripheral surface of each heald installation section, said first and second engaging means being capable of cooperation with each other to prevent the rotation of each heald around its axis.

20. A heald assembly as claimed in claim 19, wherein said first engaging means includes a projection formed at said flat inner wall surface of each heald frame beam member, and said second engaging means includes a groove formed at said flat peripheral surface of each heald installation section, said projection being capable of engagement with said groove.

21. A heald assembly of a loom comprising:

a heald frame including first and second straight elongated beam members, said first beam member being located over said second beam member, said first and second beam members being formed respectively with first and second inner faces which face toward each other;

means defining first and second straight elongated openings in said first and second beam members, respectively, each elongated opening extending along the length of the corresponding beam member;

means defining first and second straight elongated slits on said first and second inner faces, each elongated slit extending along the length of the corresponding beam member, said first and second elongated slits merging in said first and second elongated openings, respectively, each elongated slit being smaller in width than the corresponding elongated opening;

a plurality of healds each including an elongated heald body, and first and second installation sections secured at the opposite end portions of said heald body, said first and second installation sections being disposed respectively within said first and second elongated openings so that a part of said heald body is located within each elongated slit, each heald installation section being larger in width than said elongated slit;

means for preventing metal-to-metal contact between said heald installation section and said heald frame beam member; and means for preventing the rotation of each heald around its axis, said rotation preventing means including a straight elongated projection formed on the inner wall surface of said elongated opening and extending along the length of said beam member, said elongated projection being located opposite to said elongated slit and fitting in a groove on said heald installation section.

* * * * *